US007810330B1

(12) United States Patent
Weaver et al.

(10) Patent No.: US 7,810,330 B1
(45) Date of Patent: Oct. 12, 2010

(54) POWER GENERATION USING THERMAL GRADIENTS MAINTAINED BY PHASE TRANSITIONS

(75) Inventors: Samuel C. Weaver, Knoxville, TN (US); Daniel Weaver, Boulder, CO (US); Samuel P. Weaver, Boulder, CO (US)

(73) Assignee: Cool Energy, Inc., Knoxville, TN (US)

( * ) Notice: Subject to any disclaimer, the term of this patent is extended or adjusted under 35 U.S.C. 154(b) by 427 days.

(21) Appl. No.: 11/467,819

(22) Filed: Aug. 28, 2006

(51) Int. Cl.
*F01K 27/00* (2006.01)

(52) U.S. Cl. ..... 60/641.1; 60/641.2; 60/641.8

(58) Field of Classification Search ..... 60/641.1, 60/641.2, 641.8
See application file for complete search history.

(56) References Cited

U.S. PATENT DOCUMENTS 3,006,146 A 10/1961 Jackson
3,457,722 A 7/1969 Bush
3,533,232 A 10/1970 Hodgson
3,638,420 A 2/1972 Kelly et al.
3,772,883 A 11/1973 Davoud et al.
3,996,745 A 12/1976 Davoud et al.
3,998,056 A * 12/1976 Clark ..... 60/641.13
4,055,962 A * 11/1977 Terry ..... 62/102
4,148,195 A 4/1979 Gerstman et al.
4,149,389 A * 4/1979 Hayes et al. ..... 62/79
4,313,304 A * 2/1982 Hunt ..... 60/641.8
4,339,930 A 7/1982 Kirts
4,412,418 A 11/1983 Beale
4,433,550 A 2/1984 Durenec
4,522,033 A 6/1985 Jensen
4,532,778 A * 8/1985 Clark et al. ..... 62/477
4,586,334 A 5/1986 Nilsson, Sr. et al.
4,753,072 A 6/1988 Johansson et al.
4,894,989 A 1/1990 Mizuno et al.
4,897,997 A 2/1990 Meijer et al.
4,981,014 A * 1/1991 Gallagher ..... 60/412
5,010,734 A 4/1991 Ho
5,115,157 A 5/1992 Blumenau (Continued)

FOREIGN PATENT DOCUMENTS

DE 3834703 * 4/1990

(Continued)

OTHER PUBLICATIONS

Senft, James R, "An Introduction to Stirling Engines", Moriya Press, 1993, pp. 40-43.

(Continued)

*Primary Examiner*—Hoang M Nguyen
(74) *Attorney, Agent, or Firm*—Townsend and Townsend and Crew LLP

(57) ABSTRACT

Power is generated from an ambient environment through the use of thermodynamic engines. A thermodynamic engine is disposed in the ambient environment and converts heat provided in the form of a temperature differential to a nonheat form of energy. Conditions in the ambient environment induce a phase transition in a heat-transport medium that causes the temperature differential. The heat-transport medium is renewed by allowing inducing a reverse phase transition in the heat-transport medium, permitting the heat-transport medium to repeatedly or continuously undergo the phase transition that causes the temperature differential.

24 Claims, 6 Drawing Sheets

U.S. PATENT DOCUMENTS

| | | | | |
|---|---|---|---|---|
| 5,180,035 | A | 1/1993 | Gaudlitz | |
| 5,195,321 | A | 3/1993 | Howard | |
| 5,228,293 | A | 7/1993 | Vitale | |
| 5,343,632 | A | 9/1994 | Dinh | |
| 5,428,653 | A | 6/1995 | El-Genk | |
| 5,438,846 | A | 8/1995 | Datta | |
| 5,638,684 | A | 6/1997 | Siegel et al. | |
| 5,706,659 | A | 1/1998 | Houtman | |
| 5,782,084 | A | 7/1998 | Jarvis | |
| 5,875,863 | A | 3/1999 | Jarvis et al. | |
| 5,899,071 | A | 5/1999 | Stone et al. | |
| 5,916,140 | A | 6/1999 | Hageman | |
| 5,918,463 | A | 7/1999 | Penswick et al. | |
| 5,934,076 | A | 8/1999 | Coney | |
| 6,286,310 | B1 | 9/2001 | Conrad | |
| 6,305,442 | B1 | 10/2001 | Ovshinsky et al. | |
| 6,330,800 | B1 | 12/2001 | Price et al. | |
| 6,470,679 | B1 | 10/2002 | Ertle | |
| 6,536,207 | B1 | 3/2003 | Kamen et al. | |
| 6,606,860 | B2 | 8/2003 | McFarland | |
| 6,625,992 | B2 * | 9/2003 | Maguire et al. | 62/6 |
| 6,701,721 | B1 | 3/2004 | Berchowitz | |
| 6,948,315 | B2 * | 9/2005 | Kirby et al. | 60/653 |
| 6,996,988 | B1 | 2/2006 | Bussard | |
| 2004/0118449 | A1 | 6/2004 | Murphy et al. | |
| 2005/0172623 | A1 | 8/2005 | Hurt | |
| 2005/0279094 | A1 | 12/2005 | Yoshino | |

FOREIGN PATENT DOCUMENTS

| | | | |
|---|---|---|---|
| DE | 19843600 | A1 | 3/1999 |
| JP | 4093559 | A | 3/1992 |

OTHER PUBLICATIONS

"Low-Cost Solar-Thermal-Electric Power Generation," author unknown, found online on Jul. 18, 2008 at http://www.cs.berkeley.edu/~artin/Research/research.html, 6 pages.

Der Menassians, Artur, "Stirling Engines for Low-Temperature Solar-Thermal-Electric Power Generation," Written Dissertation from the University of CA Berkeley, 2007, 205 pages.

Der Menassians, Artur, "Stirling Engines for Low-Temperature Solar-Thermal-Electric Power Generation," Dissertation Talk, Nov. 19, 2007, 34 pages.

* cited by examiner

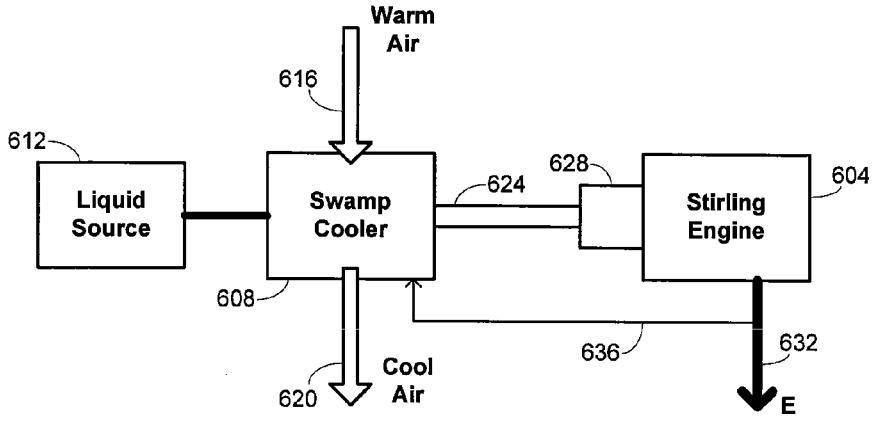
Fig. 6
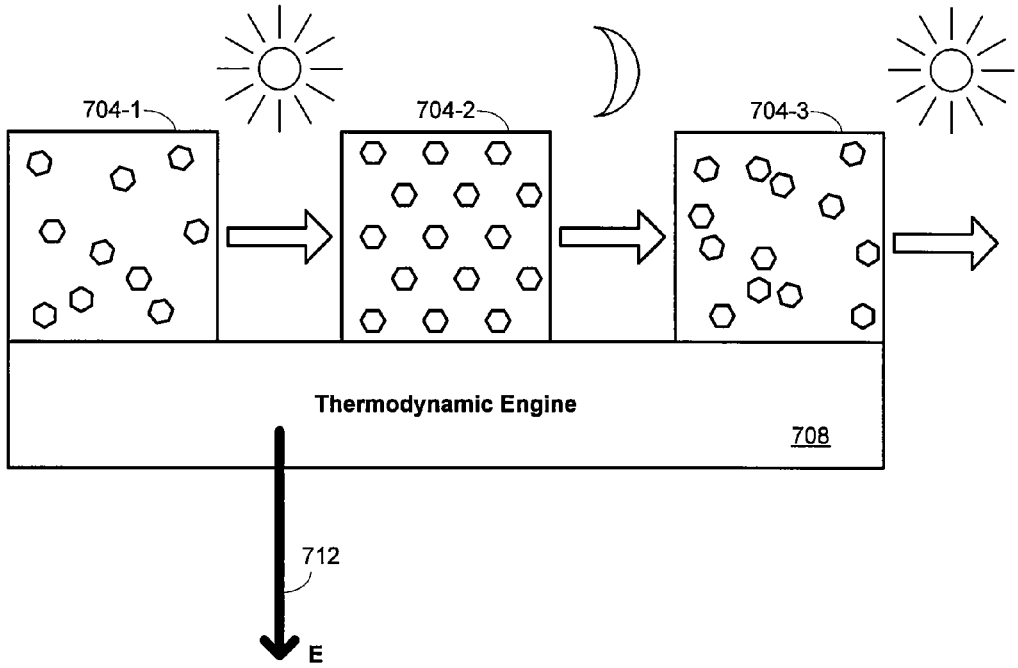

POWER GENERATION USING THERMAL GRADIENTS MAINTAINED BY PHASE TRANSITIONS

BACKGROUND OF THE INVENTION

This application relates generally to power generation. More specifically, this application relates to the use of phase transitions to maintain thermal gradients in power generation.

The use of thermodynamic techniques for converting heat energy into mechanical, electrical, or some other type of energy has a long history. The basic principle by which such techniques function is to provide a large temperature differential across a thermodynamic engine and to convert the heat represented by that temperature differential into a different form of energy. Typically, the heat differential is provided by hydrocarbon combustion, although the use of other techniques is known. Using such systems, power is typically generated with an efficiency of about 30%, although some internal-combustion engines have efficiencies as high as 50% by running at very high temperatures.

Conversion of heat into mechanical energy is typically achieved using an engine like a Stirling engine, which implements a Carnot cycle to convert the thermal energy. The mechanical energy may subsequently be converted to electrical energy using any of a variety of known electromechanical systems. Thermoelectric systems may be used to convert heat into electrical energy directly, although thermoelectric systems are more commonly operated in the opposite direction by using electrical energy to generate a temperature differential in heating or cooling applications.

While various power-generation techniques thus exist in the art, there is still a general need for the development of alternative techniques for generating power. This need is driven at least in part by the wide variety of applications that make use of power generation, some of which have significantly different operational considerations than others.

BRIEF SUMMARY OF THE INVENTION

Embodiments of the invention provide methods and systems for generating power from an ambient environment through the use of thermodynamic engines. A thermodynamic engine is disposed in an ambient environment. The thermodynamic engine is configured to convert heat provided in the form of a temperature differential to a nonheat form of energy. A heat-conduction assembly is also provided in the ambient environment, the heat-conduction assembly comprising a heat-transport medium in thermal communication with the thermodynamic engine. Conditions in the ambient environment induce a phase transition in the heat-transport medium that causes the temperature differential with the ambient environment. The thermodynamic engine is run to convert heat energy from the temperature differential with the ambient environment into the nonheat form of energy. The heat-transport medium is renewed by allowing the ambient environment to change conditions to induce a reverse phase transition in the heat-transport medium, permitting the heat-transport medium to repeatedly or continuously undergo the phase transition that causes the temperature differential with the ambient environment.

Different types of thermodynamic engines may be used in different embodiments. For instance, in one embodiment the thermodynamic engine comprises a Stirling engine and the nonheat form of energy comprises mechanical energy. In another embodiment, the thermodynamic engine comprises a thermoelectric engine and the nonheat form of energy comprises electrical energy. In addition to renewing the heat-transport medium by inducing a reverse phase transition, heat-transport medium lost in the phase transition may sometimes be replaced.

In some instances, a second heat-transport medium is also provided in thermal communication with the thermodynamic engine so that a phase transition may be induced in the second heat-transport medium to enhance the temperature differential. A thermal contribution to the temperature differential from the phase transition in the second heat-transport medium may be opposite in direction to a thermal contribution to the temperature differential from the phase transition in the second heat-transport medium.

The method may also make use of different types of phase transitions. In one embodiment, the phase transition is selected from the group consisting of a liquid-gas phase transition, a solid-liquid phase transition, and a solid-gas phase transition. In another embodiment, the phase transition comprises a transition between polymorphs and/or allotropes of the heat-transport medium. Examples of heat-transport media that may be used in different embodiments include water and cryogens.

In some embodiments, movement of the ambient environment is induced to increase a rate of the phase transition. The efficiency of running the thermodynamic engine to convert heat from the ambient environment into the nonheat form of energy may sometimes be less than 10%.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sublabel is associated with a reference numeral and follows a hyphen to denote one of multiple similar components. When reference is made to a reference numeral without specification to an existing sublabel, it is intended to refer to all such multiple similar components.

FIG. 6 provides a schematic illustration of a first application of methods of the invention; and FIG. 7 provides a schematic illustration of a second application of methods of the invention.

DETAILED DESCRIPTION OF THE INVENTION

Figures 1A, 1B, 1C, 1D:
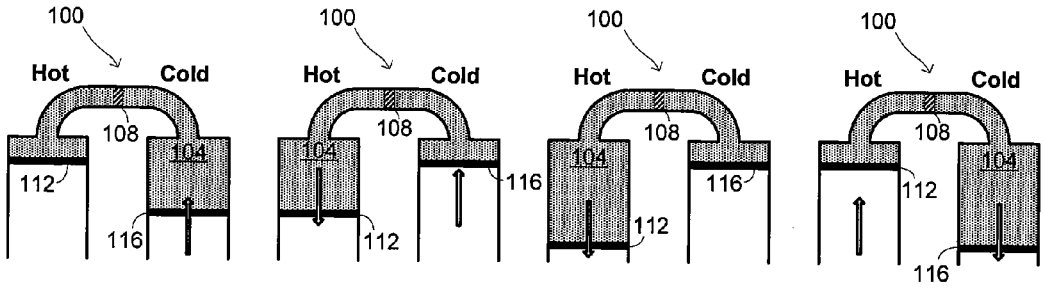
FIGS. 1A-1D show different stages in the operation of a two-piston Stirling engine.

Embodiments of the invention make use of phase transitions to maintain a thermal gradient in driving a thermodynamic engine in power-generation applications. As used herein, a "thermodynamic engine" refers to any device or system capable of converting thermal energy to a different form of energy. Examples of thermodynamic engines include engines like external and internal combustion engines that effect an energy conversion between mechanical energy and a temperature differential; and engines like thermoelectric, pyroelectric, and thermophotovoltaic engines that effect a conversion between electrical energy and a temperature differential.

A Stirling engine is sometimes referred to in the art as an "external combustion engine" and typically operates by burning a fuel source to generate heat that increases the temperature of a working fluid, which in turn performs work. The operation of one type of conventional Stirling engine is illustrated in FIGS. 1A-1E. Each of FIGS. 1A-1D shows the configuration of the Stirling engine 100 at a different position during a single cycle, with the engine 100 operating by changing positions sequentially from FIG. 1A to FIG. 1D and then returning to the configuration shown in FIG. 1A. The phase diagram shown in FIG. 1E also shows this cycle, but from the perspective of relevant thermodynamic variables. The phase diagram is a pressure-volume diagram, with pressure being plotted on the ordinate and volume being plotted on the abscissa. Relevant isotherms 124 and 128 are shown with dotted lines.

The mechanical energy produced by the Stirling engine 100 is indicated by positions of pistons 112 and 116. To use or retain the energy, the pistons 112 and 116 may be connected to a common shaft that rotates or otherwise moves in accordance with the changes in piston positions that result from operation of the engine 100. A confined space between the two pistons 112 and 116 is filled with a compressible fluid 104, usually a compressible gas. The temperature difference is effected by keeping one portion of the fluid 104, in this instance the portion on the left, in thermal contact with a heat source and by keeping the other portion, in this instance the portion on the right, in thermal contact with a heat sink. With such a configuration, piston 112 is sometimes referred to in the art as an "expansion piston" and piston 116 is sometimes referred to as a "compression piston." The portions of the fluid are separated by a regenerator 108, which permits appreciable heat transfer to take place to and from the fluid 104 during different portions of the cycle described below. This heat transfer either preheats or precools the fluid 104 as it transitions from one chamber to the other.

Figure 1E:
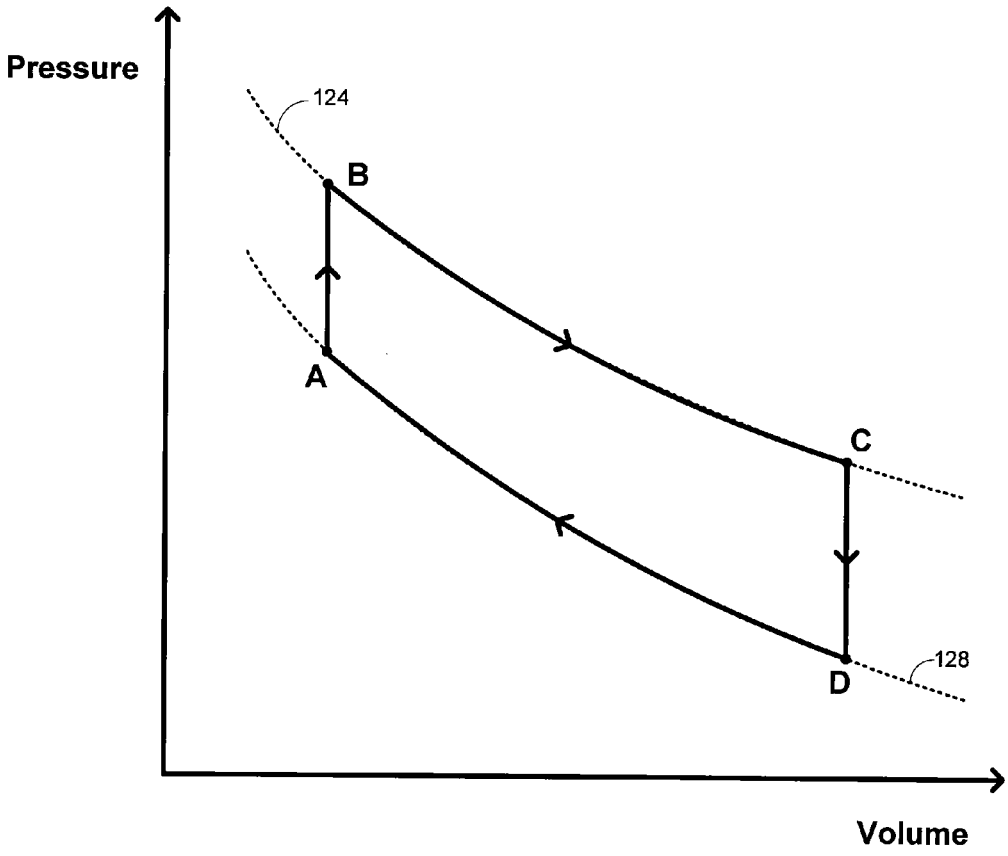
FIG. 1E is a phase diagram showing the thermodynamic operation of the Stirling engine.

When the engine is in the position shown in FIG. 1A, the fluid 104 has a pressure and volume that correspond to point "A" in FIG. 1E. In this phase diagram, isotherm 128 corresponds to a temperature $T_c$ of the cold side and isotherm 124 corresponds to a temperature $T_h$ of the hot side. During the portion of the cycle from FIG. 1A to FIG. 1B, the expansion piston 112 moves down at the same time that the compression piston 116 moves up, maintaining a constant volume for the fluid 104. During such a change, fluid 104 passes through the regenerator 108 from the cold side to the hot side. Heat $Q_R$ supplied by the regenerator 108 causes the fluid to enter the hot side at temperature $T_h$. The constant volume of this part of the cycle is represented by a vertical line in FIG. 1E to point "B."

The transition to the configuration shown in FIG. 1C is achieved by maintaining the compression piston 116 in a substantially fixed position while moving the expansion piston 112 downwards to increase the volume containing the fluid 104. This causes the fluid to undergo a substantially isothermal expansion, as represented in the phase diagram by a traversal along isotherm 124 to point "C." During this expansion, heat $Q_h$ is absorbed into the working fluid at temperature $T_h$ from the thermal contact of the fluid 104 with the heat source. The heat is turned into mechanical work W during this expansion.

The portion of the cycle to FIG. 1D is a counterpart to the portion of the cycle between the configurations of FIGS. 1A and 1B, with both pistons 112 and 116 moving in concert to maintain a substantially constant volume. In this instance, however, fluid is forced in the other direction through the regenerator 108, causing a decrease in temperature to $T_c$ represented by the vertical line in FIG. 1E to point "D." During this part of the cycle, substantially the same amount of heat $Q_R$ absorbed during the transition between FIGS. 1A and 1B is given up to the regenerator 108. The two constant-volume transitions in the cycle accordingly have substantially no net effect on the heat-transfer characteristics of the process.

Finally, a return is made to the configuration of FIG. 1A by moving the compression piston 116 upwards while maintaining the expansion piston 112 in a substantially fixed position. The resulting compression of the fluid 104 is again substantially isothermic, as represented by the traversal along isotherm 128 at temperature $T_c$ in FIG. 1E back to point "A." During this compression, heat $Q_c$ is removed from the working fluid as a result of contact of the fluid 104 with the heat sink.

The net result of the cycle is a correspondence between (1) the mechanical movement of the pistons 112 and 116 and (2) the absorption of heat $Q_h$ at temperature $T_h$ and the rejection of heat $Q_c$ at temperature $T_c$. The work performed by the pistons 112 and 116 is accordingly $W=|Q_h-Q_c|$.

The type of Stirling engine illustrated in FIGS. 1A-1D is a two-piston type of Stirling engine. This type of configuration is sometimes referred to in the art as having an "alpha" configuration. Other configurations for Stirling engines may be implemented that traverse a similar thermodynamic path through the pressure-volume phase diagram of FIG. 1E. One alternative configuration for a Stirling engine uses a displacer-type of engine, an example of which is illustrated schematically in FIGS. 2A-2D. This type of configuration is sometimes referred to in the art as having a "gamma" configuration. The fundamental principle of operation of the displacer type of Stirling engine is the same as for the two-piston type of Stirling engine in that thermal energy represented by a temperature differential is converted to mechanical energy. Still other types of configurations may be used in implementing a Stirling engine, including arrangements that are sometimes referred to in the art as having a "beta" configuration.

With the displacer-type of Stirling engine 200, fluid 224 that expands with a heat-energy increase is held within an enclosure that also includes a displacer 228. The fluid 224 is typically a gas. One or both sides of the engine 200 are maintained in thermal contact with respective thermal reservoirs to maintain the temperature differential across the engine. In the illustration, the top of the engine 200 corresponds to the cold side and the bottom of the engine 200 corresponds to the hot side. A displacer piston 204 is provided in mechanical communication with the displacer 228 and a power piston 208 is provided in mechanical communication with the fluid 224. Mechanical energy represented by the motion of the power piston 208 may be extracted with any of a variety of mechanical arrangements, with the drawing explicitly showing a crankshaft 216 in mechanical communication with both the displacer and power pistons 204 and 208. The crankshaft is illustrated as mechanically coupled with a flywheel 220, a common configuration. This particular mechanical configuration is indicated merely for illustrative purposes since numerous other mechanical arrangements will be evident to those of skill in the art that may be coupled with the power piston 208 in extracting mechanical energy. In these types of embodiments, the displacer 228 may also have a regenerator function to permit heat transfer to take place to and from the fluid 224 during different portions of the cycle.

It is noted that in the illustrated embodiment, the direct crankshaft provides a displacer motion that is substantially sinusoidal. More generally, a variety of alternative techniques may be used to couple or decouple the motion of the displacer. For instance, alternative displacer motions may be provided through the use of Ringbom-type engines and free piston designs, among others.

Figure 2A:
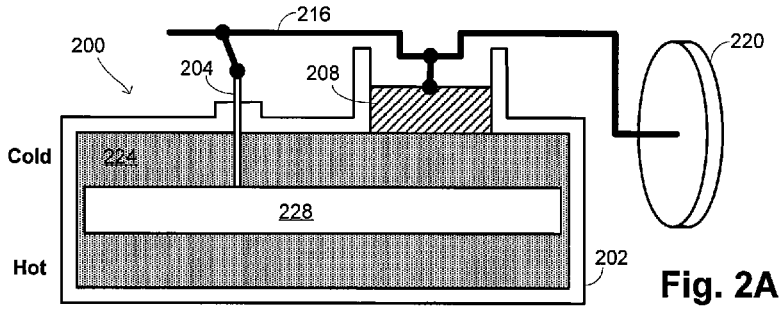
FIGS. 2A-2D show different stages in the operation of a displacer-type Stirling engine.
Figure 2B:
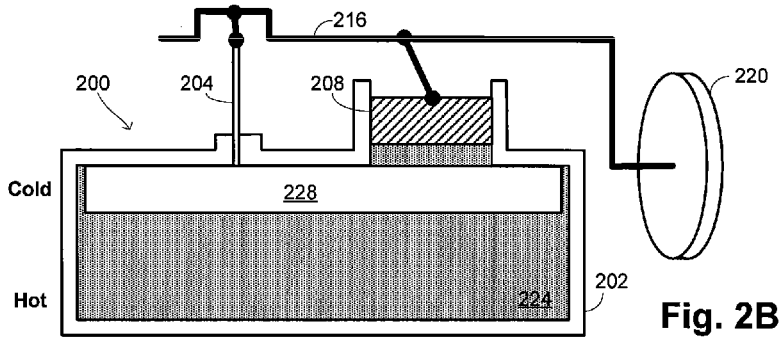

When the displacer Stirling engine 200 is in the configuration shown in FIG. 2A, it has a thermodynamic state corresponding to point "A" in FIG. 1E. Heating of the fluid 224 on the lower side of the engine 200 causes the pressure to increase, resulting in movement of the power piston 208 upwards as illustrated in FIG. 2B. This transition is represented thermodynamically in FIG. 1E with a transition to point "B." With the fluid 224 primarily in contact with the hot side of the engine, expansion of the fluid 224 takes place to drive the power piston 208 further upwards. This transition is substantially isothermic and is illustrated in FIG. 1E with a transition to point "C," corresponding to the arrangement shown in FIG. 2C.

Figure 2C:
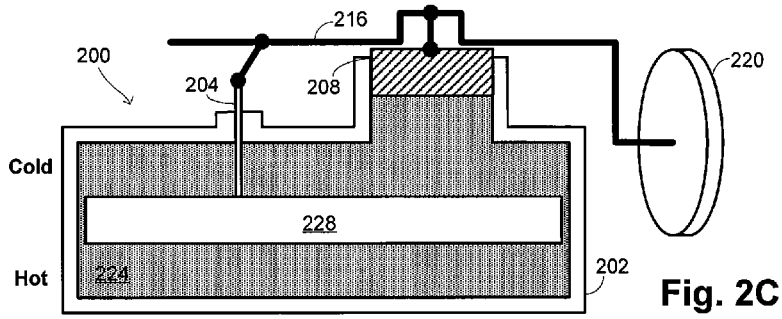
Figure 2D:
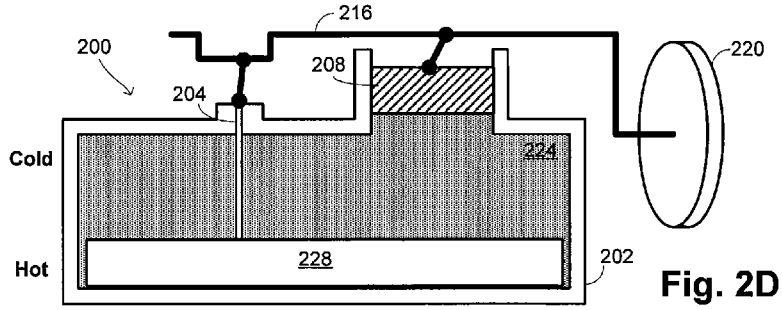

In FIG. 2C, expansion of the fluid 224 has been accompanied by reverse motion of the displacer 228, causes more of the fluid 224 to come in contact with the cold side of the engine 200 and thereby reduce the pressure. This is illustrated in FIG. 1E with the transition to point "D," corresponding to the arrangement shown in FIG. 2D. Cooling of the fluid 224 induces a substantially isothermic contraction illustrated in FIG. 1E with a return to point "A" and with the engine returning to the physical configuration shown in FIG. 2A.

This basic cycle is repeated in converting thermal energy to mechanical energy. In each cycle, the pressure increases when the displacer 228 is in the top portion of the enclosure 202 and decreases when the displacer 228 is in the bottom portion of the enclosure 202. Mechanical energy is extracted from the motion of the power piston 208, which is preferably 90° out of phase with the displacer piston 204, although this is not a strict requirement for operation of the engine.

Other types of thermodynamic engines make use of similar types of cycles, although they might not involve mechanical work. For instance, thermoelectric engines typically exploit the Peltier-Seebeck effect, which relates temperature differentials to voltage changes. Other physical effects that may be used in converting temperature differentials directly to electrical energy include thermionic emission, pyroelectricity, and thermophotovoltaism. Indirect conversion may sometimes be achieved with the use of magnetohydrodynamic effects.

Figure 3A:
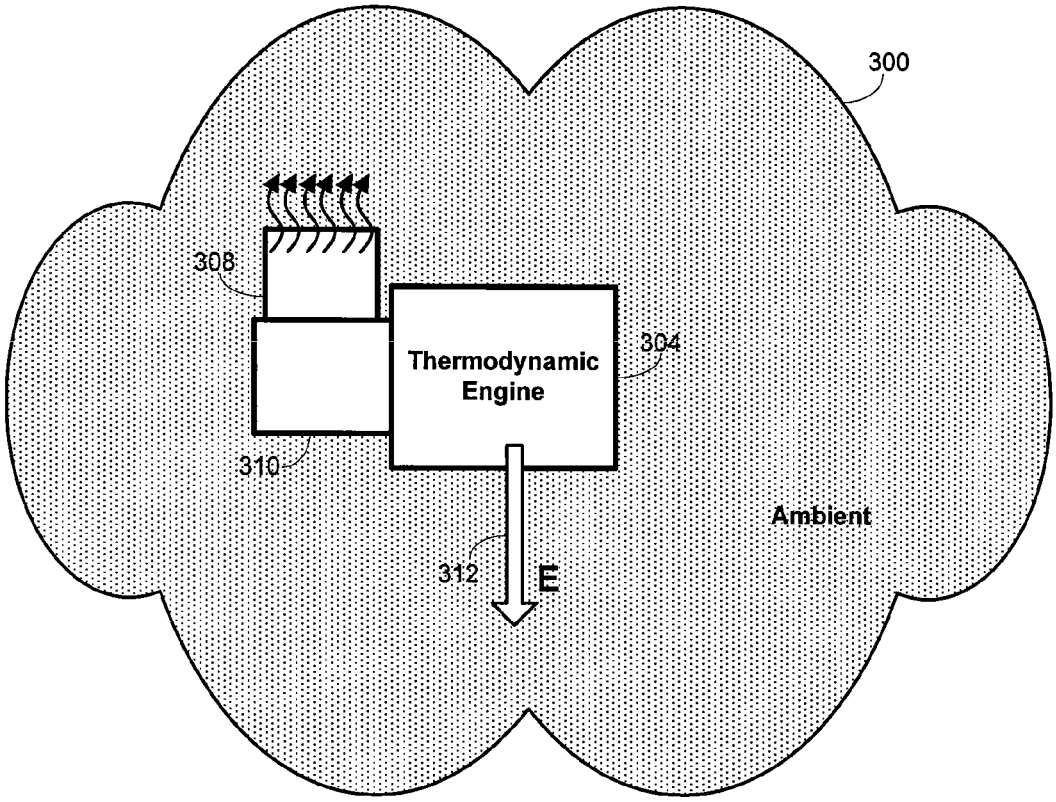
FIGS. 3A and 3B are schematics illustrating embodiments of the invention for using thermal gradients maintained by phase transitions in power generation.

Embodiments of the invention dispose a thermodynamic engine in an ambient environment as illustrated schematically in FIG. 3A. In these embodiments, the ambient environment 300 itself is used as the heat source, with a temperature differential being provided across the thermodynamic engine 304 with a volume of heat-transport medium 308 disposed on a heat-sink structure 310 that is in thermal communication with the engine. In addition to acting as the heat source, the ambient environment 300 has conditions that induce a phase transition in the heat-transport medium 308. The invention is not intended to be limited by the particular type of thermodynamic engine 304 that is used. While some of the discussion that follows explains operation in the context of a Stirling engine like that described above, this is done merely for illustrative purposes; other types of thermodynamic engines, particularly including thermoelectric, pyroelectric, and thermophotovoltaic engines may be used in alternative embodiments.

The wavy arrows emanating from the heat-transport medium 308 in the drawing suggest a phase transition from a liquid to a gas, but the invention is not limited to any particular type of phase transition. Different types of phase transitions may be used to remove energy from the heat sink in different embodiments. For instance, in some alternative embodiments, a solid-liquid phase transition may be used or a solid-gas phase transition may be used. These types of phase transitions are generally produced by appropriate combinations of temperature and pressure of the ambient environment 300 and different embodiments of the invention may use a variety of different materials. Merely by way of example, water may be used as the heat-transport medium 308, being provided initially in either its solid or liquid states, with the pressure and temperature of the ambient environment 300 being such that it melts or evaporates in maintaining the temperature differential. In some instances, cryogens that have very low transition points may be used in generating greater temperature differentials.

In other embodiments, transitions between different molecular structures, particularly of solids, may be used in maintaining the temperature differential. For example, transitions between polymorphs or allotropes may be induced by conditions in the ambient environment 300, reflected by transitions between two different crystalline structures of a solid or transitions between an amorphous structure and a crystalline structure. Still other types of phase transitions that maintain the temperature differential in accordance with conditions of the ambient environment 300 may be used in other embodiments.

As used herein, the term "ambient" environment is intended to refer to the overall environment within which the thermodynamic engine 304 operates. As such, the volume of the ambient environment 300 is large relative to the volume of the heat-transport medium 308 such that the conditions of the ambient environment are substantially unchanged by operation of the thermodynamic engine 304. Specifically, such conditions as the temperature, pressure, humidity, and the like of an environment within which thermodynamic engine 304 operates will be substantially unaffected by operation of the engine 304. In many instances, the "ambient" environment thus refers to the atmospheric environment where the thermodynamic engine 304 is disposed. While it is possible in some specialized applications to prepare an environment with particular characteristics, such as within a building or other structure that has a controlled temperature and/or humidity, such an environment is considered to be "ambient" only where it is substantially larger than the volume of heat-transport medium 308 and substantially unaffected by operation of the thermodynamic engine 304. It is noted that this definition of an "ambient" environment does not require a static environment. Indeed, conditions of the environment may change as a result of numerous factors other than operation of the thermodynamic engine—the temperature, humidity, and other conditions may change as a result of regular diurnal cycles, as a result of changes in local weather patterns, and the like.

In some embodiments, the ambient environment 300 comprises air that is in motion, either as a result of natural air-motion patterns generated by wind or the like or as a result of an imposition of motion by a fan or similar device. Depending on the specific nature of the phase transition being used to maintain thermal gradients, this air motion may increase the rate at which the phase transition occurs and may simultaneously enhance warming of the heat-source side of the thermodynamic engine.

The basic principle of operation of the configuration shown in FIG. 3A is to remove energy from the heat-transport medium 308 with the induced phase transition. The ambient environment provides a heat source, providing the resultant temperature difference to drive the thermodynamic engine for extraction of energy E 312. This principle permits thermal energy to be extracted from the ambient environment as long as the conditions of that environment permit the phase transition to maintain the temperature differential. In embodiments where the ambient environment is the atmospheric environment, the ultimate source of the energy 312 derived by operation of the energy is direct or indirect solar energy.

Figure 3B:
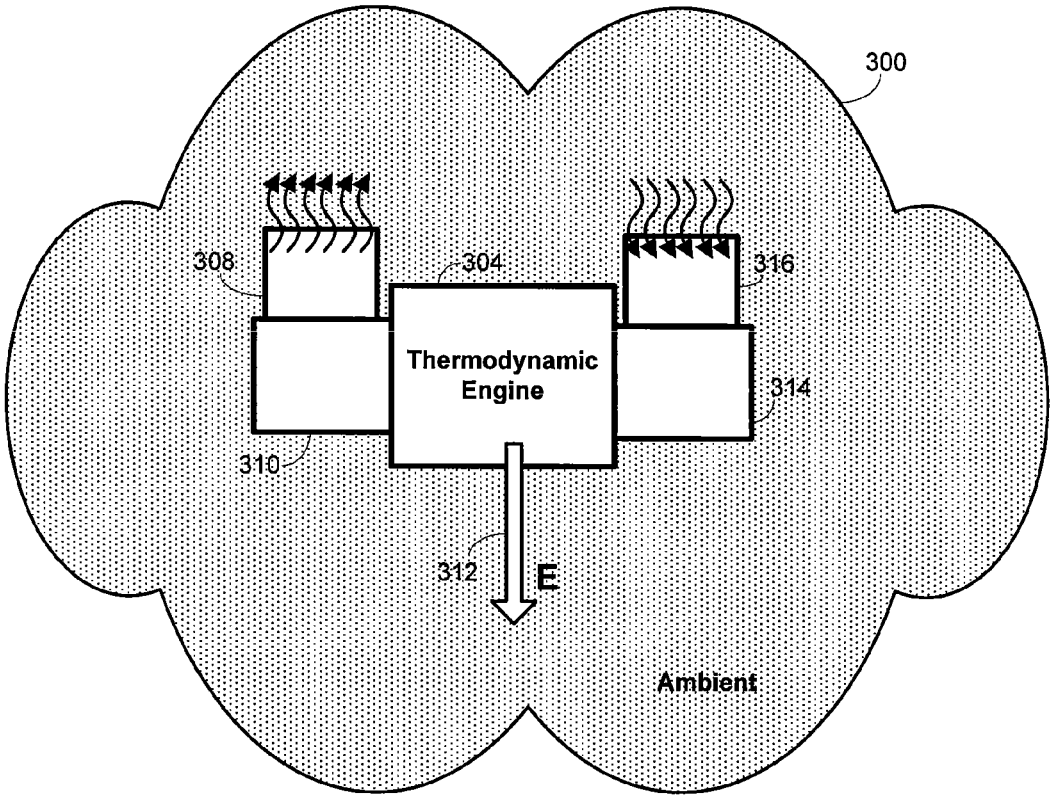

A variation of this principle of operation is shown in FIG. 3B, which makes use of a parallel structure on the hot side of the thermodynamic engine. In these embodiments, a heat-source structure 314 supports a second heat-transfer medium 316 that undergoes a phase transition to provide a source of heat. The first and second heat-transfer media 308 and 316 may be selected so that conditions in the ambient environment induce the respective phase transitions. For instance, the first heat-transfer medium 308 might have a melting temperature less than the ambient temperature and the second heat-transfer medium 316 might have a melting temperature greater than the ambient temperature. Conditions in the ambient would then induce a melting of the first heat-transfer medium 308 to provide a heat sink and would induce a freezing of the second heat-transfer medium 316 to provide a heat source.

Figure 4:
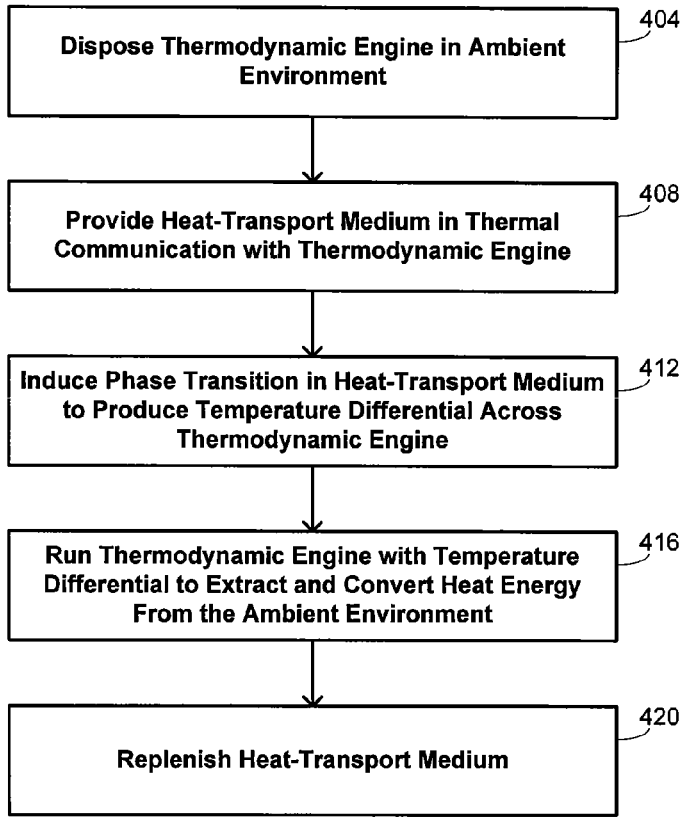
FIG. 4 is a flow diagram summarizing methods for generating power in various embodiments.

A general overview of methods of the invention is thus provided with the flow diagram of FIG. 4. As indicated at block 404, a thermodynamic engine is disposed within an ambient environment. As previously noted, a variety of different types of thermodynamic engines may be used in different embodiments, with Stirling engines, thermoelectric engines, pyroelectric engines, and thermophotovoltaic engines providing specific examples. A heat-transport medium is provided in thermal communication with the thermodynamic engine at block 408. There is considerable variety in the specific materials that may be used as the heat-transport medium, provided that a phase transition can be induced at block 412 to produce a temperature differential across the thermodynamic engine. As previously noted, water or other materials that undergo liquid-gas, solid-liquid, or solid-gas phase transitions may be used, as may materials that undergo amorphous-crystalline phase transitions or transitions between different crystalline states.

Alternatively or in addition, a phase-change medium may be provided to provide a heat source, as illustrated in FIG. 3B above. Such embodiments permits a realization of embodiments in which different phase changes are effected with different phase-transition media to provide heat as well as remove heat. It also permits a realization of embodiments in which a particular phase change may be used both as a heat source and as a heat sink in the system under conditions that define the directionality of the phase transition.

The thermodynamic engine is run at block 416 with the temperature differential to convert heat energy to mechanical, electrical, or some other form of nonheat energy. In some embodiments, the efficiency with which this conversion is performed is relatively low, being less than 25%, less than 20%, less than 15%, less than 10%, less than 5%, less than 2%, or less than 1% in various different embodiments. In the art of thermodynamic engines, efficiencies at this level have frequently been dismissed as being insufficiently effective to provide acceptable power generation. The focus in the art has conventionally been concentrated on the development of high-efficiency engines. While it remains true that higher efficiencies are generally preferable to lower efficiencies, the inventors have discovered compensatory advantages with embodiments of the invention that have relatively low efficiency. In particular, the cost of providing a heat-transport medium that permits extraction of energy from the ambient environment may be substantially lower than the cost of high-efficiency engines, making the methods described herein commercially practical.

This advantage is, moreover, enhanced in embodiments where the heat-transport medium is replenishable, as indicated at block 420. In some embodiments, continued or repeated running of the thermodynamic engine 304 may be maintained by providing new heat-transport medium to replace heat-transport medium consumed by the phase transitions. In other embodiments, the replenishment may be achieved by restoring a prior state of the heat-transport medium, thereby permitting the same mass of material to be reused repeatedly. This is particularly advantageous when cyclic conditions of the ambient environment cause a reverse phase transition of the heat-transport medium. During this period, the thermodynamic engine may be prevented from running in reverse and thereby returning heat to the ambient environment.

Thus, during a first portion of a cycle, conditions in the ambient environment would be such that the thermodynamic engine operates to generate power from thermal gradients maintained as the heat-transport medium undergoes a transition from a first phase to a second phase. This is followed by a second portion of the cycle when conditions in the ambient environment have changed so that the heat-transport medium undergoes a transition from the second phase back to the first phase while the thermodynamic engine is dormant. This prepares the system for subsequent power generation when the ambient environment cycles back to conditions similar to those that existed during the first portion of the cycle. There are various combinations of phase transitions and environmental conditions that may combine effectively in producing such a scheme. One example is where the cycle is a daily cycle that has a first portion when temperatures are high and a second portion when temperatures are low, permitting the use of a heat-transport medium that undergoes a solid-liquid phase transition during the first portion and a liquid-solid phase transition during the second portion. Another example is an industrial process that has steps that produce differing levels of waste heat at different steps of the process, which can similarly be used to effect a phase transition in a material that is used to drive a thermal engine during one step of the process, with the material being returned to a different phase during a subsequent step of the process.

Figure 5:
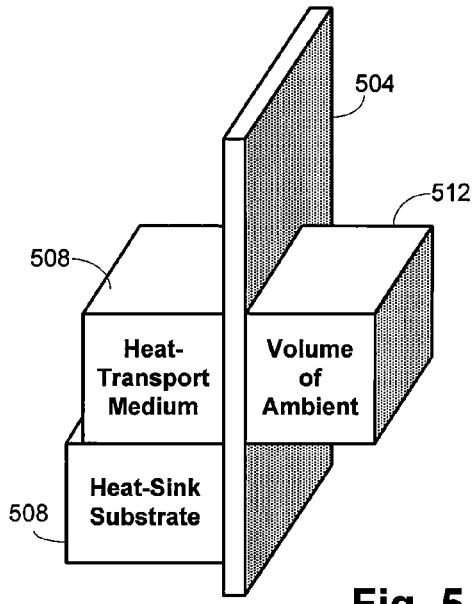
FIG. 5 is a schematic illustration of the operation of a thermodynamic engine in an embodiment.

Illustrations of how the efficiencies affect power generation may be considered with reference to FIG. 5. In this illustration, the thermodynamic engine is a Stirling engine 504, the heat-transport medium 508 is liquid water disposed on the heat-sink substrate 510, with the arrangement maintaining the cold side of the Stirling engine 504 at a temperature of 285 K by evaporation, and the ambient environment 512 is air at 300 K at sea level. The ambient air 512 has a molecular density $$\rho = \frac{6.023 \times 10^{23} \text{ moecules/mole}}{2.240 \times 10^{4} \text{ cm}^3\text{/mole}} = 2.69 \times 10^{19} \text{ molecules/cm}^3.$$

With a heat capacity c of $1.381 \times 10^{-23}$ J/(molecule K), the energy of the air 512 at 300 K is $$(300 \text{ K}) \times \left(1.381 \times 10^{-23} \frac{\text{J}}{\text{molecule} \cdot \text{K}}\right) = 4.143 \times 10^{-21} \text{ J/molecule}.$$

Therefore, a 1 $cm^3$ of air 512 at 300 K as illustrated in FIG. 5 has $$(2.69 \times 10^{19} \text{ molecules}) \times (4.143 \times 10^{-21} \text{ J/molecule}) = 0.1114 \text{ J}$$

of energy. If the Stirling engine 504 acts as a perfect Carnot heat pump without air circulation, about 5% of the source air's energy is transferred to the heat sink 508. The volume of air needed to generate 1 kWh is thus $$\begin{aligned} V &= \frac{1 \text{ kWh}}{(0.1114 \text{ J/cm}^3) \times \text{Efficiency}} \\ &= \frac{3.6 \times 10^{6} \ Ws}{(0.1114 \ Ws/\text{cm}^3) \times 0.05} \\ &= 6.46 \times 10^{8} \text{ cm}^3 \\ &= 646 \text{ m}^3. \end{aligned}$$

This amount of air corresponds to air movement of about 300 cfm.

Example No. 1

In a first example, a power generation system made in accordance with an embodiment of the invention is integrated with a swamp cooler. As is known to those of skill in the art, a swamp cooler is a type of air conditioner that is used to cool buildings, usually in dry climates. The mechanism of operation uses evaporative cooling, making swamp coolers especially effective in areas that have a hot, dry atmosphere. One configuration is illustrated schematically in FIG. 6. This illustration provides an example of a combined system that might be deployed to cool a building and generate electricity simultaneously.

A swamp cooler 608 acts by intaking warm, dry air 616 from the ambient environment and evaporating liquid supplied by a liquid source 612. Evaporative cooling of the liquid may be aided with internal mechanisms such as a fan, with the swamp cooler outputting cooled air 620 that has a higher humidity than the ambient air taken into the system. The evaporative cooling that takes place within the swamp cooler 608 thus provides a phase transition from liquid to gas that may be used to drive a temperature difference of a Stirling engine 604 or other thermodynamic engine. A conduit 624 or other mechanism for providing thermal communication between the swamp cooler 624 and a sink side 628 of the engine 604 is thus provided. The engine 604 operates as described above, outputting energy E 632, some of which may be redirected back to the swamp cooler to drive the internal fans or other mechanisms.

In this type of arrangement, liquid acts as the heat-transport medium, and may be replenished by providing additional liquid for consumption by the integrated system. The integrated system may advantageously be deployed in an attic or other hot environment that permits establishing a relatively large temperature differential with the ambient environment.

Example No. 2

In a second example, a power generation system makes use of a material that may undergo structural transitions between a crystalline state and an amorphous state in response to temperature changes. This is illustrated schematically in FIG. 7, in which the material 704 is in thermal contact with a thermodynamic engine 708. During a daily cycle, changes in the ambient temperature induce structural changes, with the material shown in different amorphous states in elements 704-1 and 704-3, and shown in a crystalline state in element 704-2. During daylight hours, the thermodynamic engine 708 may be driven by the phase change from the amorphous state to the crystalline state, permitting energy E 712 to be generated as described above. During nighttime hours, the thermodynamic engine 708 remains dormant as the material reverts to an amorphous form, permitting it to be used again during daylight hours for power generation.

In this type of arrangement, replenishment is thus provided by the natural phase changes in the material 704 induced by environmental conditions. Deployment of such a system may be most advantageous in cooler environments, although the efficiency of the power-generation system will depend on the specific materials properties of the material 704 used.

Thus, having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method for generating power from an ambient environment, the method comprising:

providing a thermodynamic engine in the ambient environment, wherein the thermodynamic engine is configured to convert heat provided in the form of a temperature differential to a nonheat form of energy;

providing a heat-conduction assembly disposed in the ambient environment, the heat conduction assembly comprising a heat-transport medium in thermal communication with the thermodynamic engine, wherein conditions in the ambient environment induce a phase transition in the heat-transport medium that causes the temperature differential with the ambient environment;

running the thermodynamic engine to convert heat energy from the temperature differential with the ambient environment into the nonheat form of energy; and renewing the heat-transport medium by allowing the ambient environment to change conditions to induce a reverse phase transition in the heat-transport medium, whereby the heat-transport medium may repeatedly or continuously undergo the phase transition that causes the temperature differential with the ambient environment.

2. The method recited in claim 1 wherein the thermodynamic engine comprises a Stirling engine and the nonheat form of energy comprises mechanical energy.

3. The method recited in claim 1 wherein the thermodynamic engine comprises a thermoelectric engine and the nonheat form of energy comprises electrical energy.

4. The method recited in claim 1 further comprising replacing heat-transport medium lost in the phase transition.

5. The method recited in claim 1 wherein the phase transition is selected from the group consisting of a liquid-gas phase transition, a solid-liquid phase transition, and a solid-gas phase transition.

6. The method recited in claim 1 wherein the phase transition comprises a transition between polymorphs and/or allotropes of the heat-transport medium.

7. The method recited in claim 1 wherein the heat-transport medium comprises water.

8. The method recited in claim 1 wherein the heat-transport medium comprises a cryogen.

9. The method recited in claim 1 further comprising inducing movement of the ambient environment to increase a rate of the phase transition.

10. The method recited in claim 1 wherein an efficiency of running the thermodynamic engine to convert heat from the ambient environment into the nonheat form of energy is less than 10%.

11. The method recited in claim 1 further comprising:

providing a second heat-transport medium in thermal communication with the thermodynamic engine; and inducing a phase transition in the second heat-transport medium to enhance the temperature differential.

12. The method recited in claim 11 wherein a thermal contribution to the temperature differential from the phase transition in the second heat-transport medium is opposite in direction to a thermal contribution to the temperature differential from the phase transition in the second heat-transport medium.

13. A system for generating power from an ambient environment, the system comprising:

a thermodynamic engine configured to convert heat provided in the form of a temperature differential to a nonheat form of energy;

a heat-conduction assembly disposed in the ambient environment, the heat-conduction assembly comprising a heat-transport medium in thermal communication with the thermodynamic engine, wherein the ambient environment acts thermodynamically to induce a phase transition in the heat-transport medium and thereby provide the temperature differential; and a renewal mechanism for the heat-transport medium to induce a reverse phase transition in the heat-transport medium in response to changed conditions in the ambient environment, whereby the heat-transport medium may repeatedly undergo the phase transition that causes the temperature differential with the ambient environment.

14. The system recited in claim 13 wherein the thermodynamic engine comprises a Stirling engine and the nonheat form of energy comprises mechanical energy.

15. The system recited in claim 13 wherein the thermodynamic engine comprises a thermoelectric engine and the nonheat form of energy comprises electrical energy.

16. The system recited in claim 13 wherein the phase transition is selected from the group consisting of a liquid-gas phase transition, a solid-liquid phase transition, and a solid-gas phase transition.

17. The system recited in claim 13 wherein the phase transition comprises a transition between polymorphs and/or allotropes of the heat-transport medium.

18. The system recited in claim 13 wherein the heat-transport medium comprises water.

19. The system recited in claim 13 wherein the heat-transport medium comprises a cryogen.

20. The system recited in claim 13 further comprising means for inducing movement of the ambient environment to increase a rate of the phase transition.

21. The system recited in claim 13 wherein an efficiency of the thermodynamic engine in converting heat from the ambient environment into the nonheat form of energy is less than 10%.

22. The system recited in claim 13 further comprising a second heat-transport medium in thermal communication with the thermodynamic engine, wherein the second heat-transport medium undergoes a phase transition to enhance the temperature differential.

23. A system for generating power from an ambient environment, the system comprising:

means for converting heat provided in the form of a temperature differential to a nonheat form of energy;

means for providing a heat-transport medium in thermal communication with the means for converting heat, wherein the means for providing and the means for converting heat are disposed in the ambient environment, which acts thermodynamically to induce a phase transition in the heat-transport medium to provide the temperature differential; and means for replenishing the heat-transport medium to induce a reverse phase transition in the heat-transport medium in response to changed conditions in the ambient environment, whereby the heat-transport medium may repeatedly undergo the phase transition that causes the temperature differential with the ambient environment.

24. The system recited in claim 23 further comprising means for inducing movement of the ambient environment to increase a rate of the phase transition.

* * * * *